US005505450A

United States Patent [19]

Stuff

[11] Patent Number: 5,505,450

[45] Date of Patent: Apr. 9, 1996

[54] GOLF CLUB HEADS WITH MEANS FOR IMPARTING CORRECTIVE ACTION

[76] Inventor: Alfred O. Stuff, 8000 S. Orange Ave., Orlando, Fla. 32809

[21] Appl. No.: 320,460

[22] Filed: Oct. 11, 1994

Related U.S. Application Data

[63] Continuation of Ser. No. 911,650, Jul. 10, 1992, Pat. No. 5,354,059, which is a continuation-in-part of Ser. No. 474,512, Feb. 2, 1990, Pat. No. D. 327,931, and Ser. No. 498,593, Mar. 26, 1990, Pat. No. D. 327,932.

[51] Int. Cl.[6] ..... A63B 53/04

[52] U.S. Cl. ..... 273/167 J; 273/78; 273/173

[58] Field of Search ..... 273/167 J, 173, 273/175, 78, 77 A, 167H, 167 F, 169; D21/214, 217, 219, 220

[56] References Cited

U.S. PATENT DOCUMENTS

| | | | |
|---|---|---|---|
| 3,937,474 | 2/1976 | Jepson et al. | 273/78 |
| 4,754,969 | 7/1988 | Kobayashi | 273/167 H |
| 4,957,294 | 9/1990 | Long | 273/167 H |
| 5,163,682 | 11/1992 | Schmidt et al. | 273/167 J |

*Primary Examiner*—Steven B. Wong
*Assistant Examiner*—Steven B. Wong
*Attorney, Agent, or Firm*—Allen, Dyer, Doppelt, Franjola & Milbrath

[57] ABSTRACT

Golf clubs are fitted with either plural grooves extending along the face in at least two non-parallel directions or with pads, or both, for purposes of achieving a variety of different corrective actions to a golf ball struck by the face.

7 Claims, 4 Drawing Sheets

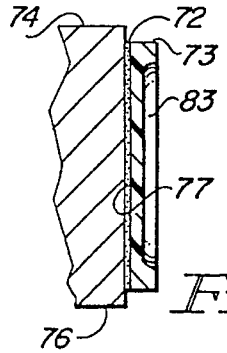
FIG. 9
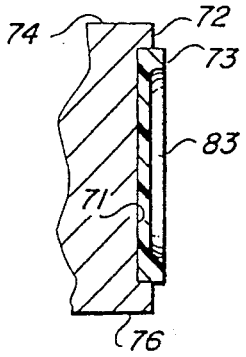
FIG. 10
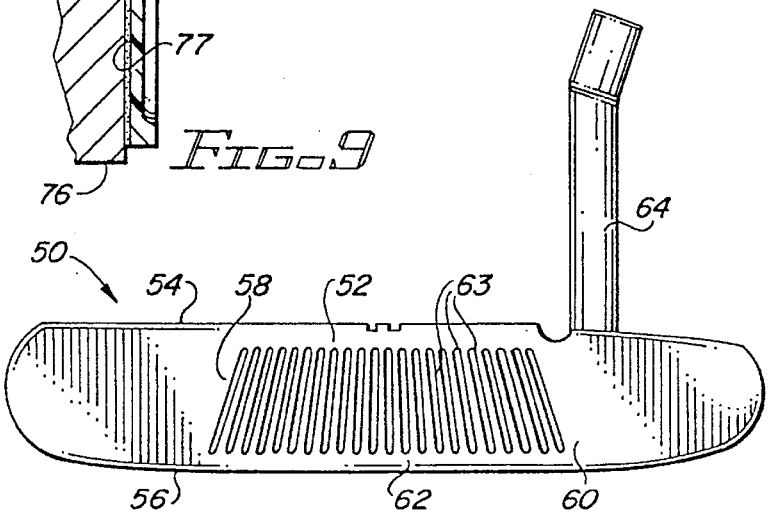
FIG. 7
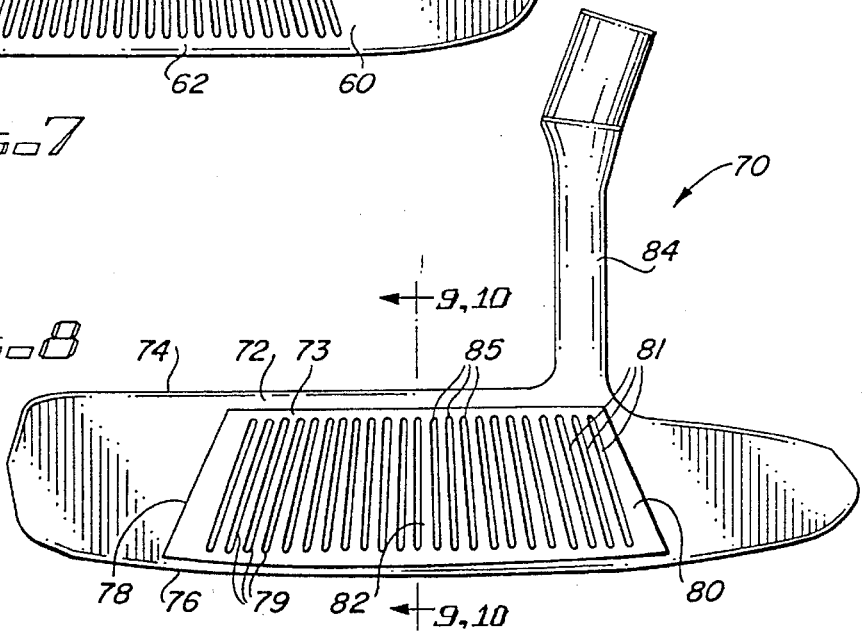
FIG. 8
FIG. 11
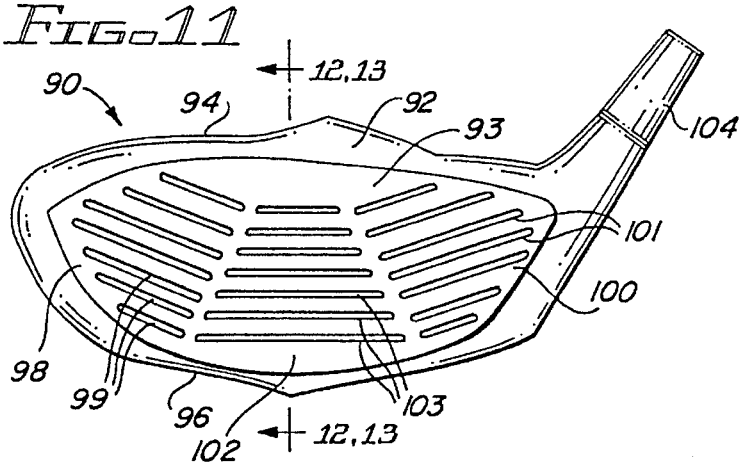
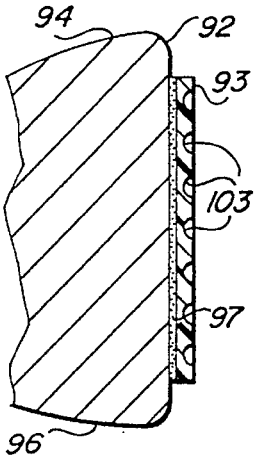
FIG. 12

GOLF CLUB HEADS WITH MEANS FOR IMPARTING CORRECTIVE ACTION

The present invention is a continuation of Ser. No. 07/911,650 filed on Jul. 10, 1992, now U.S. Pat. No. 5,354,059 which was a continuation-in-part of Ser. No. 07/474,512 filed on Feb. 2, 1990, now U.S. Design Pat. No. D327,931 and a continuation-in-part of Ser. No. 07/498,593 filed on Mar. 26, 1990 now U.S. Design Pat. No. D327,932.

BACKGROUND OF THE INVENTION

The present invention is directed to golf clubs, and in particular is directed to golf clubs having means for imparting a corrective action to a golf ball.

There have been a variety of techniques disclosed in the past for fitting a golf club head with a mechanism for imparting a corrective spin or action to a golf ball, in order to impart some desired action to the ball when struck by the club. For example, I disclosed in my earlier U.S. Pat. No. 4,530,505 a plurality of vertical slots in a putter to control back spin and skidding, and to also compensate for toe and heel shots. In U.S. Pat. No. 3,989,257, Barr discloses a putter having a convex face .intended to correct toe and heel problems. A variety of techniques for achieving similar results have also been disclosed using horizontally disposed slots and grooves in the ball-striking face of woods and irons.

SUMMARY OF THE INVENTION

The present invention has as its objective the provision for a golf club head having a ball-striking face with means along the face for imparting a desired action to a golf ball in a manner not previously achieved in the prior art.

In one form, a golf club head in accordance with the present invention achieves this objective with the inclusion of grooves extending along the face in at least two non-parallel directions. In a particular form, the grooves extend along the face in at least three non-parallel directions, with one set of grooves extending in one direction along the toe portion of the face, a second set of grooves extending along a second direction across the sweet spot and a third set of grooves extending along the heel portion of the face.

In another form, the grooves extend across the face in a multitude of different directions in a generally fan-shaped configuration.

In yet another form of the present invention, the means for imparting a desired action comprises means along the club face having a resilience substantially different than that of the club head, and preferably a resilience which is substantially greater than that of the material forming the club head. In one particular arrangement, the resilient means comprises a plastic or rubber pad fitted across the face of the golf club, or into a recess in the face of the club.

The resilient pad may take a number of different configurations to achieve various desired actions from the golf ball after being struck. For example, the resilient pad may be provided with a non-uniform resilience or thickness, or both, across the club face. For instance, if the resilient pad is tapered from a large dimension adjacent the top of the club face to a smaller dimension at the bottom of the club face, an over spin can be imparted to the ball. On the other hand, if the resilient pad is made smaller at the top of the club face and extending outwardly to a greater dimension adjacent the bottom of the face, then an underspin can be imparted to the ball. Third, if the pad is tapered in either resilience or thickness from one of the heel or toe toward the other side of the face, then a desired fade or draw spin may be imparted to the ball; or, the pad may be tapered from a smaller dimension across the sweet spot of the face, outwardly to a greater dimension across both the heel and toe, permitting the same pad to achieve both draw and fade spin. Different resilient characteristics may be imparted to the resilient pad by, for example, laminating the pad with a metal face plate, or with a plate of another material which imparts a desired characteristic. Further, the dimensions of the grooves may be controlled to provide a small groove at one edge of the resilient pad, and a larger dimension of the groove along another extremity of the pad.

DESCRIPTION OF THE DRAWINGS

FIG. 7 is a front view of a golf putter according to the present invention.

FIG. 8 is a front view of another golf putter in accordance with the present invention.

FIGS. 9 and 10 are cross-sectional illustrations of two different forms of the golf putter of FIG. 8, with the cross sections taken along the lines A—A.

FIG. 11 is a front view of a driver-type golf club according to the present invention.

FIGS. 12 and 13 are cross sections of alternative forms of the golf club of FIG. 11, taken along the lines B—B.

DETAILED DESCRIPTION

Figure 1:
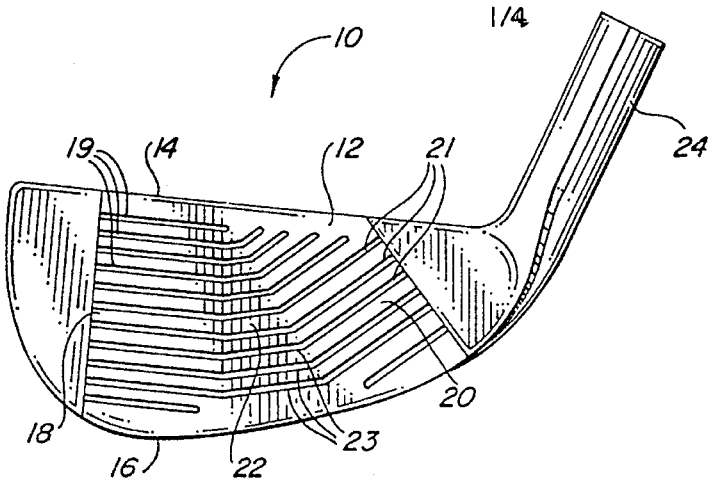
FIGS. 1, 2 and 3 are front, top and side views of a golf driving iron according to the present invention.

A driving iron according to the present invention will now be described with reference to FIGS. 1–3. The golf club, referred to generally by the reference numeral 10, includes a club face 12, a top surface 14, and a bottom edge 16. The face 12 includes a toe portion 18, a heel portion and a sweet spot 22 between the heel and the toe. It is well-known among golfers that if the ball is properly struck at the sweet spot 22, then the ball will travel in a general direction normal to the face 12. On the other hand, if the ball is struck on either the toe 18 or the heel 20, then an undesirable slice or hook is imparted to the ball, causing the ball to not only travel in a direction not normal to the face 12, but to actually have an undesirable spin to be imparted to the ball in a manner which exaggerates the error.

Figure 3:
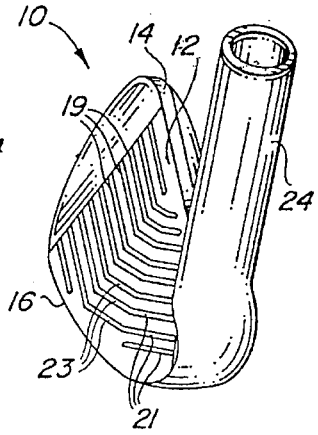
Figure 2:
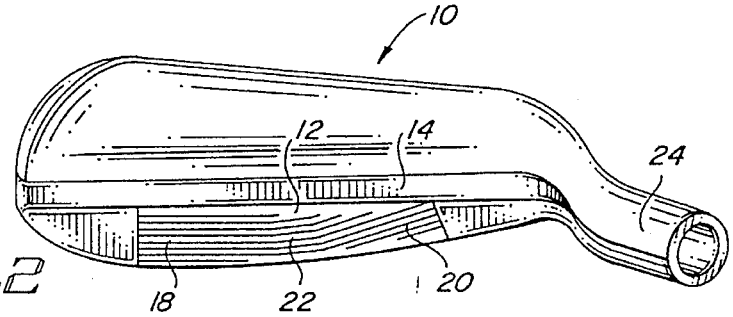

In order to correct such errors when the ball is struck on either the heel or toe, the face 12 of the club 10 is fitted with a plurality of grooves extending along the face in at least two non-parallel directions, and in the particular form of the club 10 in FIGS. 1–3, in three non-parallel directions. Included are a first set of grooves 19 extending in a first direction along the toe portion 18, a second set of grooves 21 extending parallel with each other and along a second direction across the heel portion 20, and a third set of grooves 23 extending in a third direction parallel with each other across the sweet spot 22. As shown in FIG. 1, the -first and third directions of the grooves 19 and 21 intersect along the plane of the sweet spot 22. In the particular example of the club 10 in FIGS. 1–3, the first, second and third groove sets 19, 21, and 23 are continuous across the club face, in that each set of grooves 19 and 20 are continuously connected to the grooves 23.

In use, when the golfer using the club 10 strikes the golf ball along the toe portion 18, the grooves 19 impart a draw spin to the ball, causing the ball to curve inwardly toward an imaginary line generally normal to the club face 12. Similarly, when the golfer hits the ball across the heel portion 20, the grooves 21 impart a fade spin to the ball, again pulling the ball back toward the imaginary line normal to the club face 12.

Figure 4:
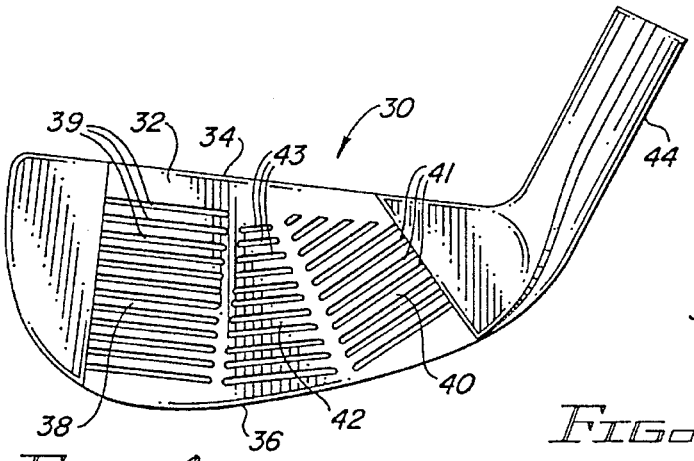
FIGS. 4, 5 and 6 are front, top and side views of a second driving iron according to the present invention.
Figure 6:
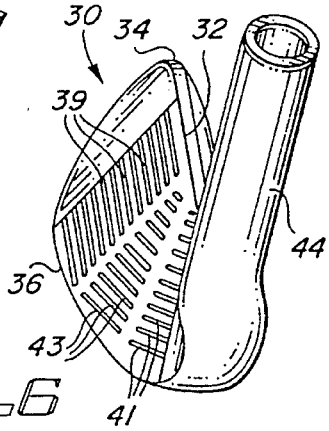
Figure 5:
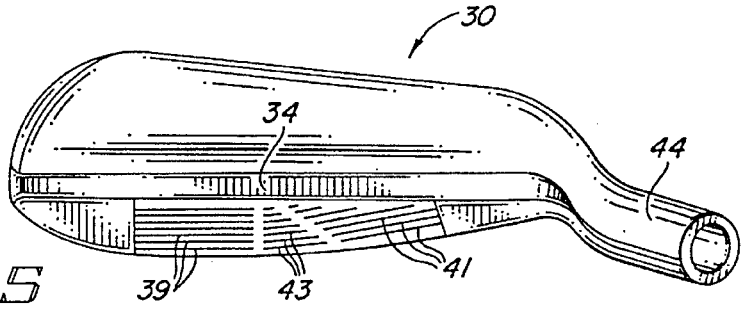

A second example of a driving iron in accordance with the present invention is illustrated in FIGS. 4–6.

The golf club, referred to generally by the reference numeral 30, includes a club face 32, top surface 34 and bottom edge 36. The club face 32 includes toe portion 38, heel portion 40 and sweet spot 42. Each of the portions 38, 40 and 42 of the club face 34 are provided with respective groove sets 39, 41 and 43, in a manner similar to that discussed above with reference to FIGS. 1–3, except that the grooves are discontinuous along the club face, as illustrated in FIG. 4.

A club shaft (not shown) may be coupled to hosel 44 to permit use of the club 30 in the manner described above.

A third example of a golf club, in this case a putter, in accordance with the present invention is shown in FIG. 7. The putter 50 includes a club face 52, top surface 54 and bottom edge 56. The face 52 includes a toe portion 58, heel portion 60 adjacent the hosel 64 and a sweet spot 62. In this example, the club face is fitted with plural grooves 63 which extend across the face from top to bottom in a generally fan-shaped configuration from top to bottom, the grooves extending in a multitude of different directions, each one with respect to the others. In use, the grooves 63 not only control back spin and skidding in the manner discussed in my aforementioned U.S. Pat. No. 4,530,505, but also impart a corrective action with respect to shots improperly hit on the toe 58 or heel 60, by virtue of the non-parallel configuration of the grooves 63.

FIG. 8 illustrates another putter in accordance with the present invention, which utilizes not only the non-parallel groove configuration, but also employs other means to impart a corrective action to the golf ball when struck. The golf club shown in FIG. 8 is referred to generally by the reference numeral 70 and includes a club face 72 having an upper surface 74, bottom edge 76 and a hosel 84. Attached across the face 72 of the club 70 is a pad 73 of a material having a resiliency substantially different, and preferably greater, than the resiliency of the material of the club 70. By way of example, the pad 73 may be formed of a plastic or rubber-like material having a durometer rating on the order of about 30–70. In the arrangement shown in FIG. 8, the pad 73 defines a toe portion 78, a heel portion 80 and an intermediate sweet spot 82, with plural, non-parallel grooves 79 extending across the face of the pad 73.

The pad 73 is capable of imparting a variety of different characteristics to the golf club 70, depending upon the particular resiliency selected, and the shape of the pad. Further, the use of a pad which is easily removed from the face 72 of the golf club (irrespective of whether the club is a putter, iron or wood) permits a variety of different score line and pad configurations to be selected. When the pad 72 has a resiliency substantially greater than that of the material of the golf club 70, unwanted vibrations that affect feel and touch are eliminated; as to woods and irons, the ball is compressed on impacting the club face thus operating at a more efficient coefficient of restitution point. This results in a different coefficient of restitution in the ball-club relationship.

As shown in FIGS. 9 and 10, the pad 73 may be affixed to the club face 72 with a removable adhesive 77 (FIG. 9); or alternatively, as shown in FIG. 10 the club face 72 may be provided with a slot 71 into which the pad 73 is force fit.

Figure 13:
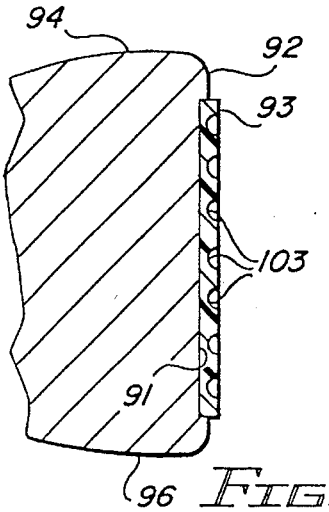

Yet another form of a golf club in accordance with the present invention is illustrated in FIGS. 11–13. The club 90 of FIG. 11 is a driver having a club face 92, a top surface 94 and a bottom edge 96. A removable pad 93 is fitted to the face 92 and defines a toe portion 98, a heel portion 100 adjacent the hosel 104, and a sweet spot 102 between the heel and toe portions. The pad 93 includes a first set of grooves 99 extending along the toe portion 98 in a first direction; the heel portion 100 includes a second set of grooves 101 extending along a second direction; and the sweet spot 102 includes a third groove set 103 extending along a third direction in a manner similar to that described above with respect to FIGS. 4–5. Further, the pad 93 may be attached to the club face 92 utilizing a removable adhesive layer 97, or alternatively may be force fit into a slot 91 across the face 92 of the club 90 as illustrated with referenced to FIGS. 12 and 13.

Figure 14:
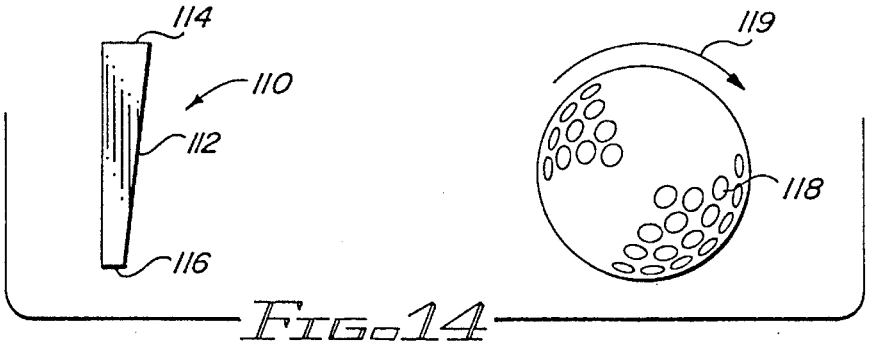
FIGS. 14–16 illustrate various forms of a resilient pad useful with the present invention, each of the figures including a representation of a golf ball and the nature of the corrective action imparted by the corresponding resilient pad.

As described above, the use of the resilient pads permits a variety of different corrective actions to be imparted to different types of golf clubs. As shown in FIG. 14, a resilient pad 110 is depicted having a tapered configuration from a greater dimension at the top 114 to the bottom 116, and defining a ball-striking face 112 between those two edges. In this example, the ball 118 is provided with an over spin, as represented by arrow 119.

Figure 15:
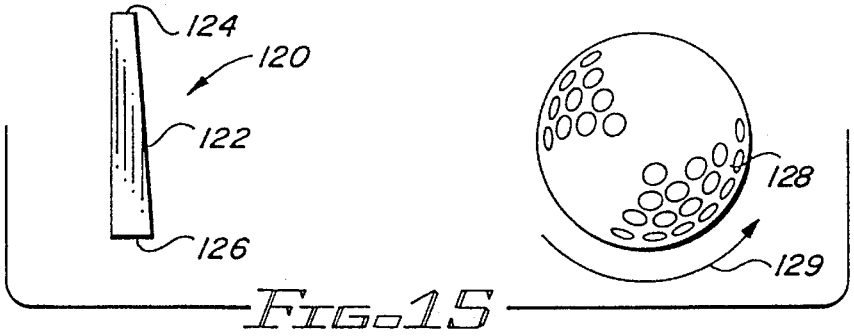

In FIG. 15, a resilient pad 120 is shown, which is tapered from a small dimension at the top 124 to a greater dimension at the bottom 126, defining a ball-striking face 122 between those two edges. In this example, an underspin is imparted to the ball 128, as depicted by arrow 129.

Figure 16:
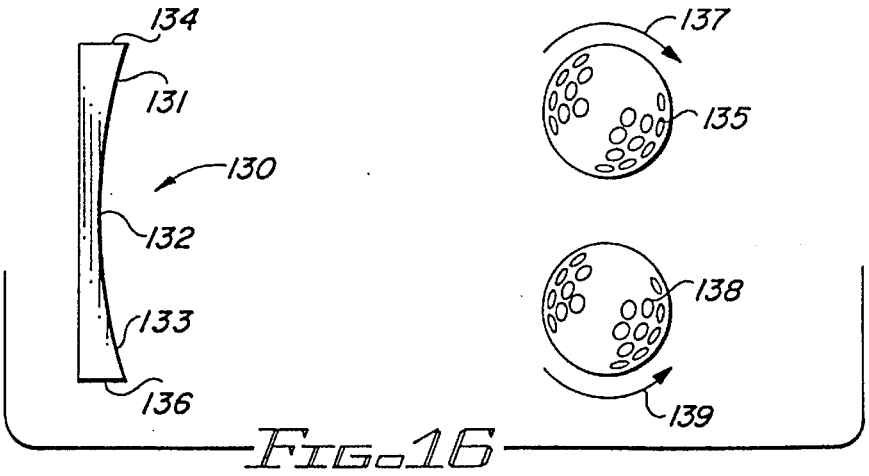

FIG. 16 illustrates a pad 130 of non-uniformed dimension from one side 134 to the other side 136, the ball-striking face 132 lying between the two. Typically, this arrangement would be utilized much in the manner as the grooves shown in the examples of FIGS. 1–3 and FIGS. 4–5, laterally across the face of the club between the toe portion 133 and the heel 131, to permit the pad 130 to impart either a draw spin to ball 138 as shown by arrow 139, or a fade spin to ball 135, as shown by arrow 137.

Figure 17:
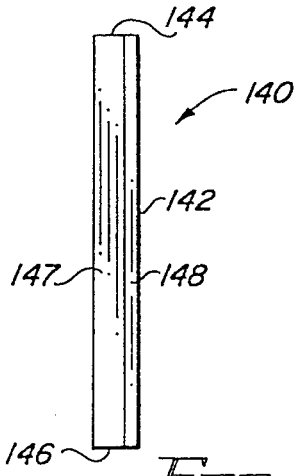
FIG. 17 illustrates an alternate form of the resilient pad of the present invention.

FIG. 17 illustrates yet another form of a pad 140 having a resilient portion 147 and a relatively non-resilient portion 148 clad to the resilient portion 147, and defining a ball-striking face 142.

It will thus be appreciated from the above descriptions of FIGS. 8–17 that the use of resilient pad permits a wide range of corrective actions to be alternately selected by the golfer, either with or without grooves in the pad, and using a selected pad shape or resiliency for various purposes. Typically, resilient pads made up of rubber-like materials and synthetics having a durometer rating on the order of between about 30–70 are sufficient to achieve the specific purposes described above, although it will be appreciated by those skilled in the art that other resiliences may be selected which are different than that of the material of the club, in order to achieve different desirable corrective actions.

Figure 18:
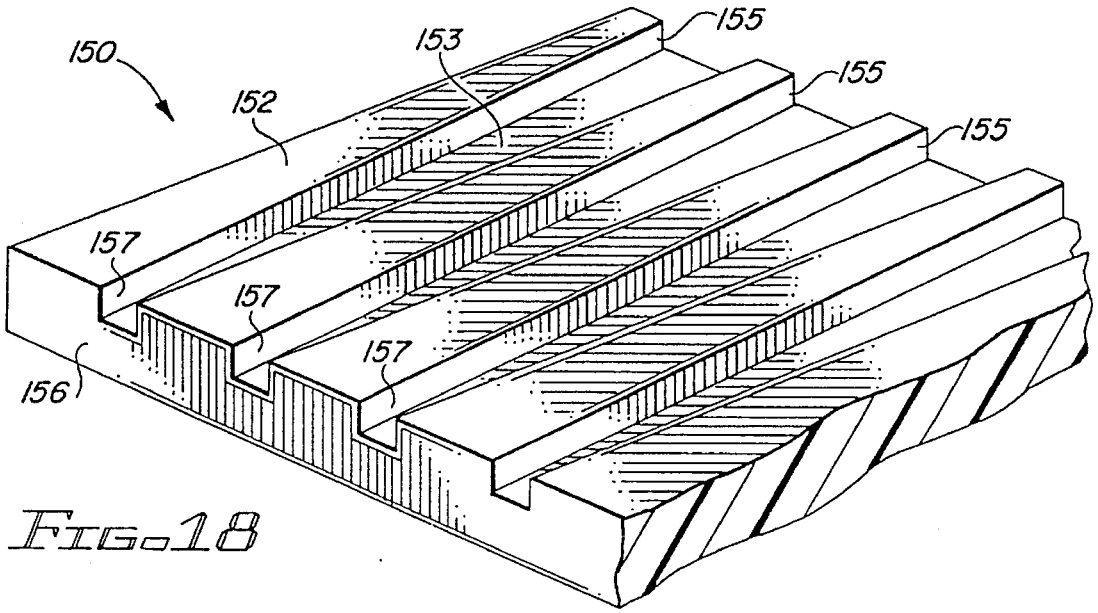
FIG. 18 is a perspective view, partially cut away, of another alternate form of the resilient pad of the present invention.
Figure 19:
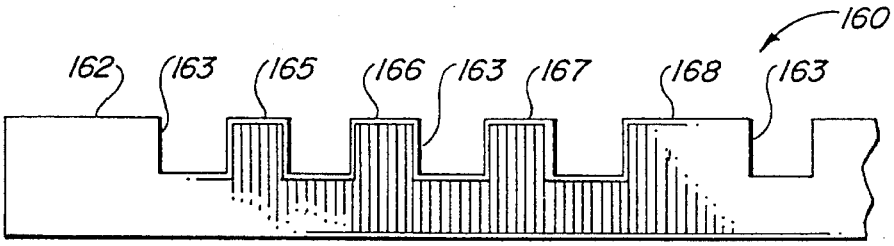
FIG. 19 is an end view illustrating another form of a resilient pad according to this invention.
Figure 20:
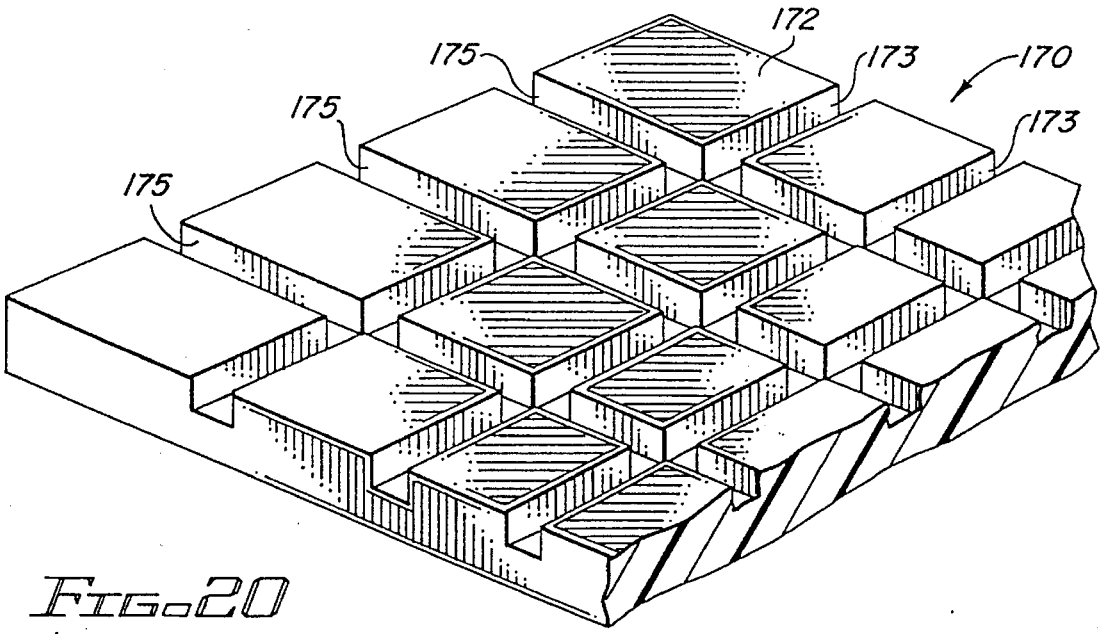
FIG. 20 is a perspective view of a portion of a resilient pad according to the invention.

Alternate forms of the groove patterns are shown in FIGS. 18–20. In the arrangement of FIG. 18, a pad 150 is provided with a face 152 and grooves 153 which taper from a small dimension at one end 157, to a larger dimension at the other end 155.

In the arrangement of FIG. 19, the pad 160 includes face 162 having plural grooves 163, the grooves being separated by lands 165, 166, 167 and 168 (for example) which are of varying dimensions across the face 162.

In the arrangement of FIG. 20, the pad 170 includes a face 172 including grooves 173 and 175 extending in orthogonal directions across the face.

From the above description, it will be appreciated by those skilled in the art that a variety of non-parallel groove and/or pad configurations may be selected to achieve an extended range of different corrective actions for golf balls, thereby assisting the golfer in the struggle to achieve a lower score.

This concludes the description of the preferred embodiments. A reading by those skilled in the art will bring to mind various changes without departing from the spirit and scope of the invention. It is intended, however, that the invention only be limited by the following appended claims.

What is claimed is:

1. A golf club head comprising:

a hosel for receiving a club shaft;

a face defining a toe portion spaced from the hosel and a heel portion adjacent the hosel wherein a sweet spot is defined between the heel and the toe portions; and a resilient pad affixed to the face for receiving a ball striking the face, the pad having a non-uniform thickness resulting in a non-uniform resiliency for providing a corrective action to the ball when the ball strikes alternate positions of the face, the pad further having a plurality of non-parallel grooves extending along a surface of the pad generally from the heel portion to the toe portion of the face, the grooves further changing the resiliency for providing further corrective action to the ball.

2. The golf club head as recited in claim 1 wherein the grooves are tapered having a first width dimension at a pad first end transitioning to a second width dimension at a pad second end, the pad first end and the pad second end at opposing face locations, the first dimension greater than the second dimension.

3. The golf club head as recited in claim 1 wherein the grooves define bands between the grooves, the grooves separated from each other by varying dimensions thereby providing bands having varying surface areas across the face.

4. The golf club head as recited in claim 1, wherein the grooves further extend generally across the club head face.

5. A golf club head comprising:.

a hosel for receiving a club shaft;

a face defining a toe portion spaced from the hosel and a heel portion adjacent the hosel wherein a sweet spot is defined between the heel and the toe portions;

a resilient pad affixed to the face for receiving a ball striking the face, the pad having a non-uniform thickness resulting in a non-uniform resiliency for providing a corrective action to the ball when the ball strikes alternate positions of the face;

the pad further having a first set of grooves running along a surface of the pad generally from the heel portion to the toe portion, and a second set of grooves extending along the pad surface, the second groove set generally orthogonal to the first groove set.

6. A golf club head comprising:

a hosel for receiving a club shaft;

a face defining a toe portion spaced from the hosel and a heel portion adjacent the hosel wherein a sweet spot is defined between the heel and the toe portions; and a resilient pad affixed to the face for receiving a ball striking the face, the pad having a non-uniform thickness resulting in a non-uniform resiliency for providing a corrective action to the ball when the ball strikes alternate positions of the face, the pad further having a plurality of grooves within a surface of the pad, the grooves generally orthogonal to an imaginary plane passing through the head from the heel portion to the toe portion.

7. The club head as recited in claim 6, wherein the grooves diverge from each other across the face from a head top portion to a head sole portion.

* * * * *